US006129229A

United States Patent [19]

Dunn et al.

[11] Patent Number: 6,129,229

[45] Date of Patent: Oct. 10, 2000

[54] PARTS PACK

[75] Inventors: Lydia Dunn, Taipei, Taiwan; James R. Dunn, Grand Prairie, Tex.

[73] Assignee: Pro-Pack International Corporation, Taipei, Taiwan

[21] Appl. No.: 09/421,890

[22] Filed: Oct. 21, 1999

[30] Foreign Application Priority Data

Oct. 2, 1999 [TW] Taiwan ..... 88216697

[51] Int. Cl.[7] ..... B65D 43/16

[52] U.S. Cl. ..... 220/4.22; 206/372; 312/902; 220/23.87; 220/23.89

[58] Field of Search ..... 220/4.22, 4.23, 220/23.87, 23.88, 23.89; 206/372, 373, 579; 312/902

[56] References Cited

U.S. PATENT DOCUMENTS

| | | | |
|---|---|---|---|
| 3,072,280 | 1/1963 | Spadaro | 220/4.22 |
| 4,340,139 | 7/1982 | Wilcox et al. | 220/4.22 |
| 4,615,461 | 10/1986 | Liu | 220/331 |
| 4,634,193 | 1/1987 | Liu | 312/107 |
| 5,076,460 | 12/1991 | Hussell | 220/4.22 |
| 5,873,463 | 2/1999 | Purcell | 206/372 |
| 6,026,999 | 2/2000 | Wakefield | 220/4.22 |

*Primary Examiner*—Joseph M. Moy
*Attorney, Agent, or Firm*—Nath & Associates; Harold L. Novick

[57] ABSTRACT

A parts pack for accommodating a plurality of pocket boxes is composed of two identical one-piece casings connected with a plurality of hinges. The parts pack can be used to store one or at least one hand tool as a screwdriver. The pocket box for accommodating various small hardware is removable from the parts pack and can be carried easily with a user for remote applications.

3 Claims, 6 Drawing Sheets

PARTS PACK

BACKGROUND OF THE INVENTION (1) Field of the Invention

The invention relates to a parts pack for sorting various small hardware such as bolts, screws and so on.

(2) Description of the Prior Art

Now and then, people use various storage boxes to accommodate small hardware such as bolts, screws, and so on. Such kind of conventional storage boxes are usually structured as a big box having a plurality of sub-boxes for sorting small hardware. Examples of those can be seen as the objects disclosed in U.S. Pat. Nos. 4,634,193 and 4,615,461. However, such conventional storage boxes are structurally complicated and have a major disadvantage of the occupation. Generally, the conventional storage boxes need to be moved to the work sites so that the hardware thereinside can be applicable. Nevertheless, some work sites do not have enough space for arranging the space-occupied storage boxes. For example, while a ladder is needed to work on the ceiling for installing an electrical lamp or an electrical fan, the worker is inevitable to move frequently up and down along the ladder to get access to the storage box on the floor for fetching appropriate hardware. Further, the conventional storage box for sorting small hardware is usually not provided with an accommodation space for hand tools such as screwdrivers, whereas those hand tools are necessary for cooperating with the small hardware inside the storage box.

Therefore, the study and development of a storage box or a parts pack with lightweight, portability, easy feasibility of specific hardware, and special storage for hand tools is a crucial topic.

SUMMARY OF THE INVENTION

In accordance with the present invention, a parts pack for accommodating a plurality of one-piece pocket boxes is composed of two identical one-piece casings connected with a plurality of hinges. The parts pack can be used to store one or at least one hand tool such as a screwdriver. The pocket box for accommodating various small hardware is removable from the parts pack and can be carried easily with a user for remote applications.

Accordingly, it is an object of the present invention to provide a parts pack, which can be easily manufactured and assembled.

It is yet another object of the present invention to provide a parts pack, which provides a plurality of portable pocket boxes for accommodating various small hardware.

It is a further object of the present invention to provide a parts pack, which provides space for accommodating one or at least one hand tool to incorporate the usage of small hardware.

BRIEF DESCRIPTION OF THE DRAWINGS

The present invention will now be specified with reference to its preferred embodiments illustrated in the drawings, in which.

DESCRIPTION OF THE PREFERRED EMBODIMENT

The invention disclosed herein is directed to a parts pack. In the following description, numerous details are set forth in order to provide a thorough understanding of the present invention. It will be appreciated by one skilled in the art that variations of these specific details are possible while still achieving the results of the present invention. In other instances, well-known components are not described in detail in order not to unnecessarily obscure the present invention.

Please refer to FIG. 1 to FIG. 5.

Figure 1:
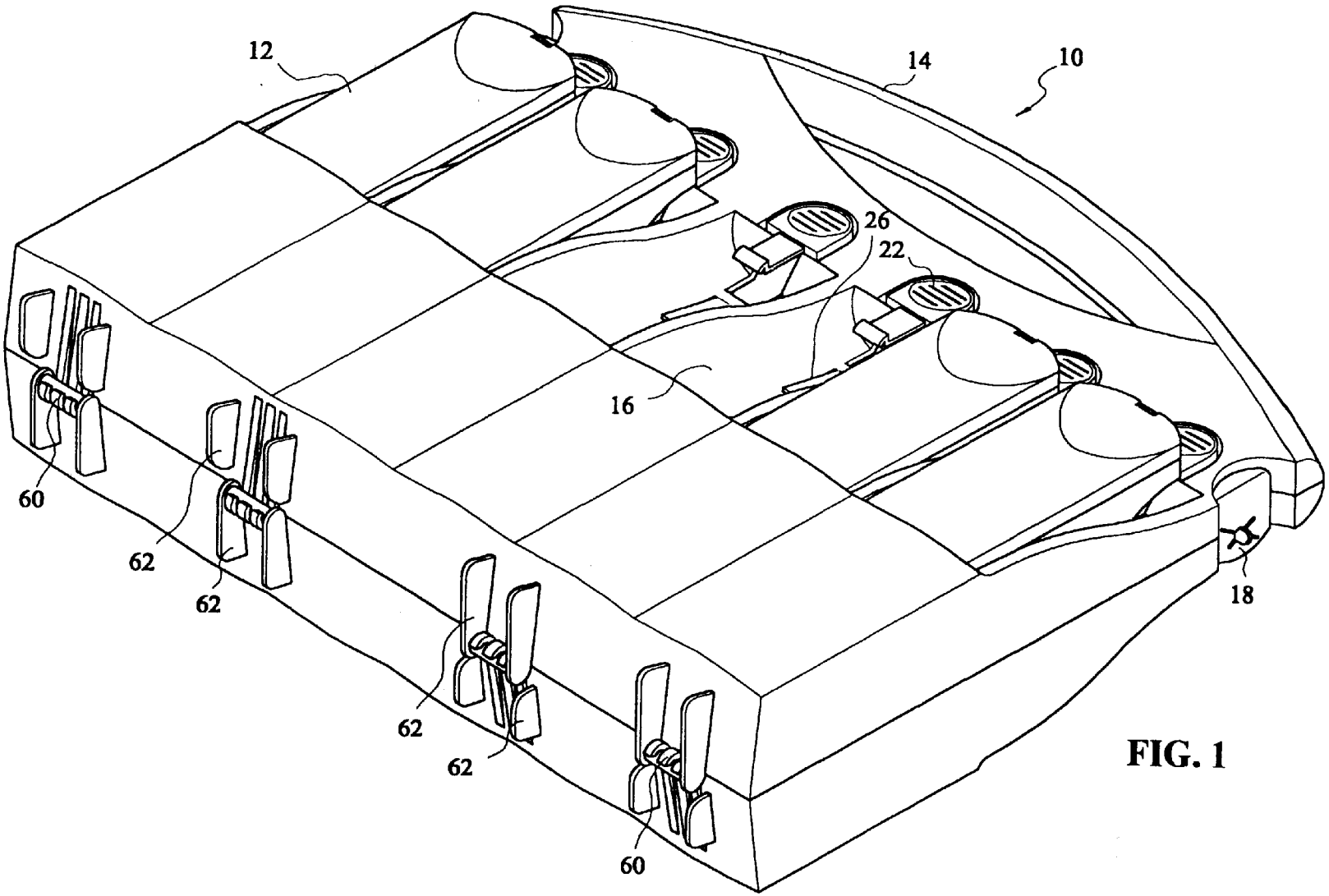
FIG. 1 is a perspective view of a preferred parts pack in accordance with the present invention, showing a close state.
Figure 2:
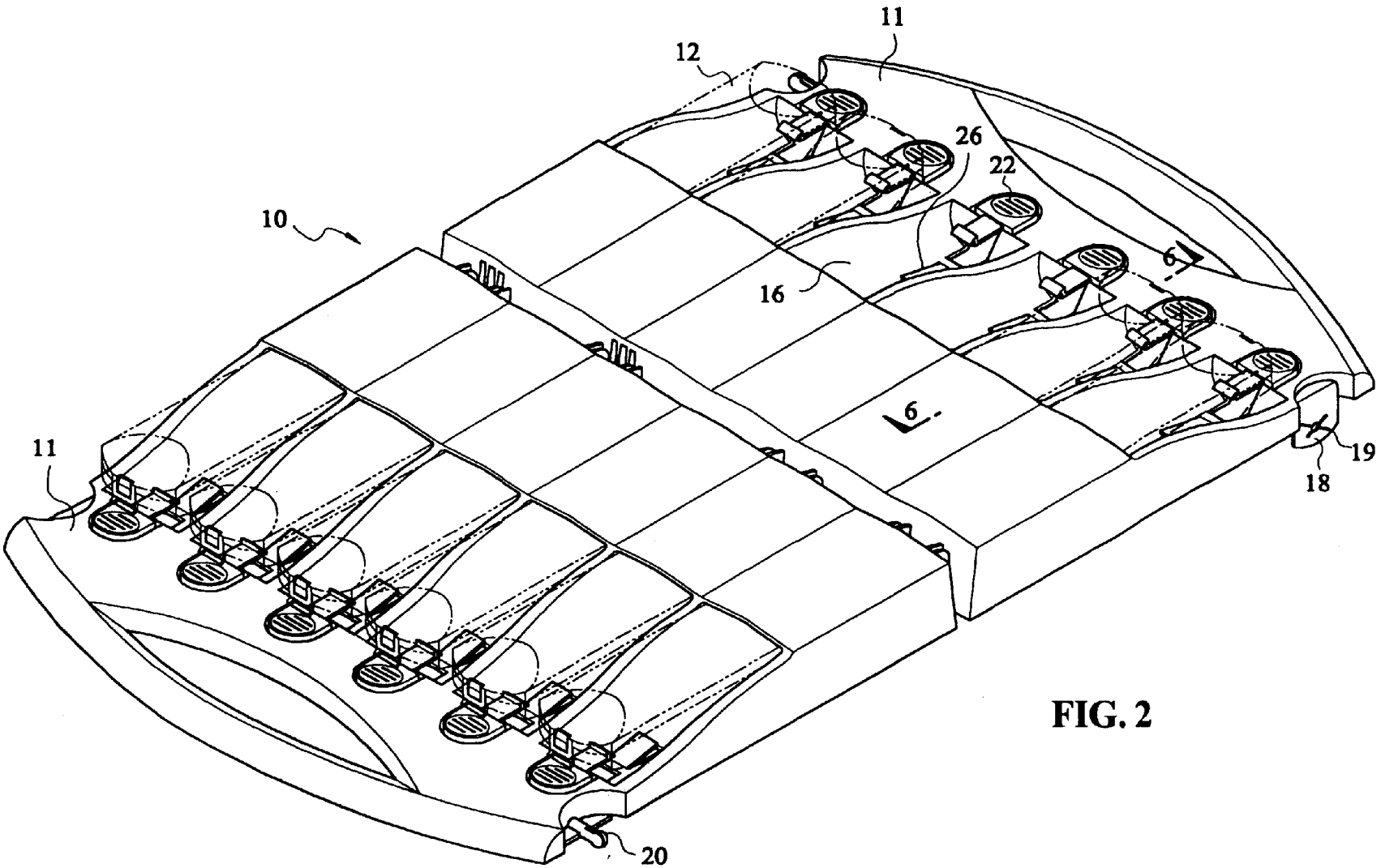
FIG. 2 is a top perspective view of the preferred parts pack of FIG. 1, showing an open state.
Figure 3:
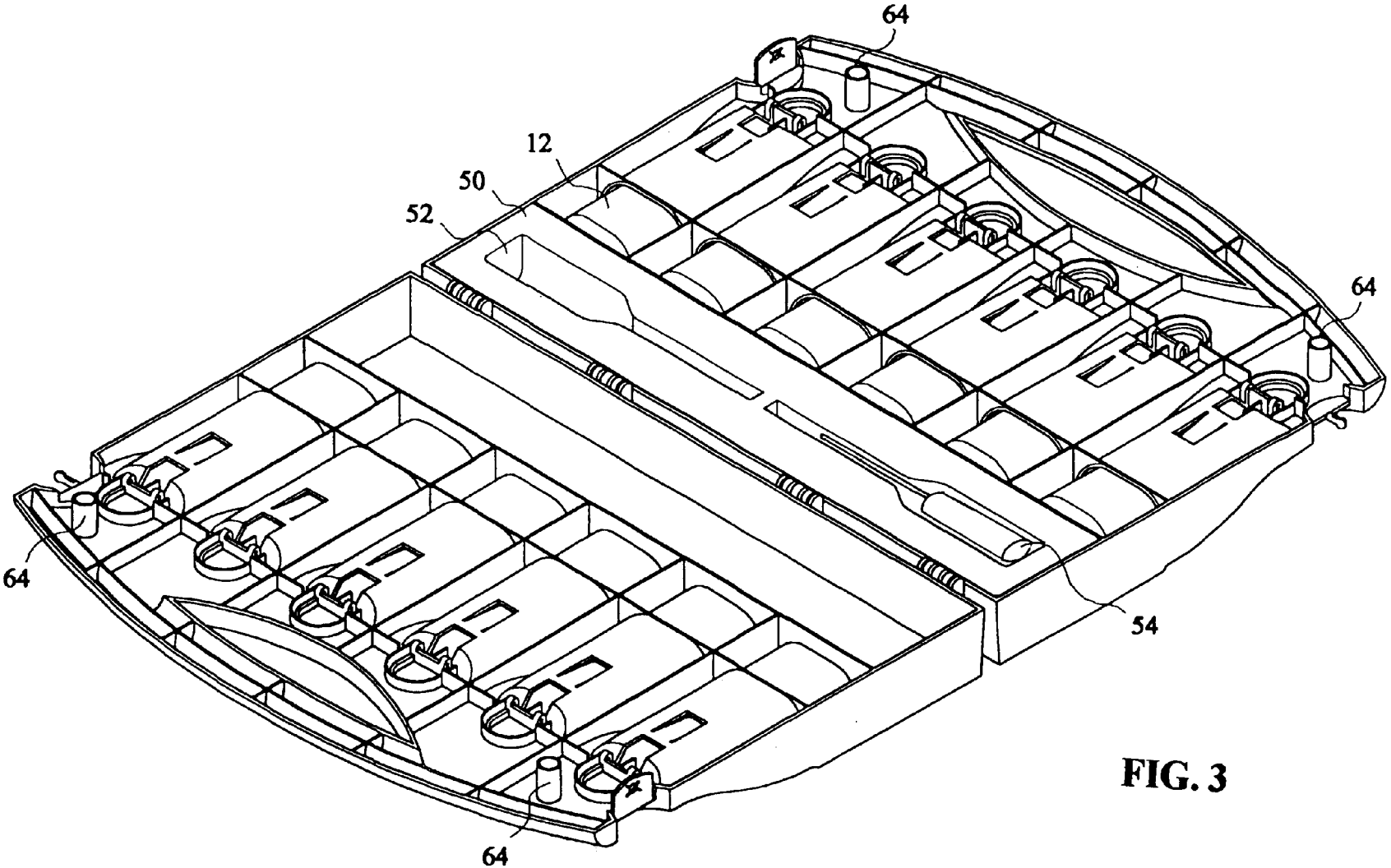
FIG. 3 is a bottom perspective view of the preferred parts pack of FIG. 1, showing the same open state as that in FIG. 2.

A parts pack 10 in accordance with the present invention is formed as a box by combining two identical one-piece casings 11 with a plurality of hinges 60. The parts pack 10 can be used to accommodate a plurality of one-piece pocket boxes 12 (as shown in FIG. 1 to FIG. 3). The casing 11 has a handle 14 formed at one end thereof, and has a plurality of first stands 62 located along an outer side of another end where a plurality of hinges 60 locate (as shown in FIG. 1 to FIG. 3). Preferably, the first stands 62 are located close to the hinges 60. The casing 11 has two lateral sides, with a holding plate 18 located at one lateral side and a holding pin 20 located at another lateral side. The holding plate 18 further includes a holding hole 19 thereon for fixedly engaging with the holding pin 20 on one casing 11 with the respective holding hole 19 of the holding plate 18 on another casing 11 (as shown in FIG. 1 to FIG. 3).

The casing 11 further includes a plurality of first accommodation spaces 16 at one surface thereof. Each first accommodation space 16 has a fastening hook 22 and a spring plate 26 thereof at one end (as shown in FIG. 1 to FIG. 3). The fastening hook 22 has a depression portion 23 at one end thereof and a hook portion 24 at another end thereof. While depressing or releasing the depression portion 23, the hook portion 24 will reach a protrusion state or a basic state, respectively. Also, a free end of the hook portion 24 is formed as a tip 28 (as shown in FIG. 1 to FIG. 3, and FIG. 6 to FIG. 8).

The casing 11 can further have a plurality of second stands 64 located at a surface opposing to the surface locating the first accommodation spaces 16 (as shown in FIG. 3).

Figure 4:
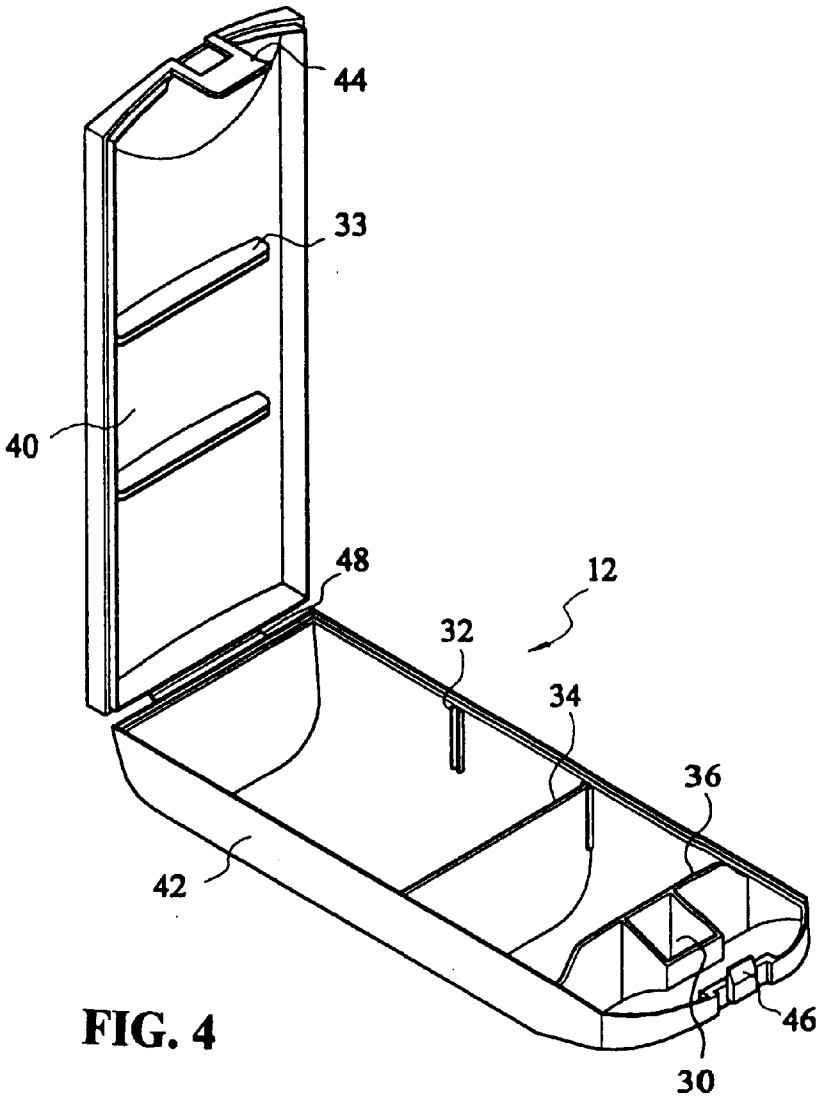
FIG. 4 is a top perspective view of the preferred pocket box in accordance with the present invention, showing an open state.
Figure 5:
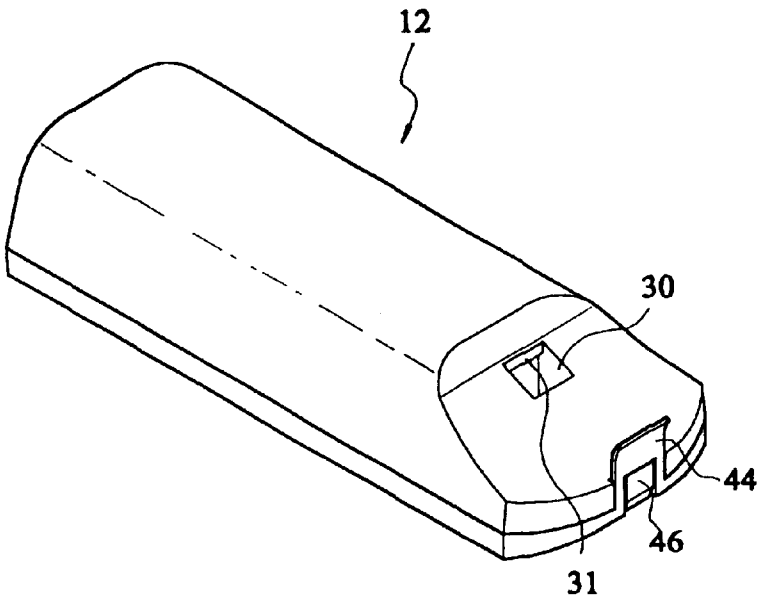
FIG. 5 is a bottom perspective view of the preferred pocket box of FIG. 4, showing the same open state as that in FIG. 4.

Each pocket box 12 is composed of an upper housing 40 and a lower housing 42, interconnected with a connecting web 48 for forming an easy openable combination of the upper housing 40 and the lower housing 42. The pocket box 12 has a division plate 36 therein located at the end away from the connecting web 48, for forming a receiving space. Further, the pocket box 12 has a through well 30 adjacent to the division plate 36. The through well 30 has a protruding fastening flange 31 thereof at an lower portion of the through well 30. Close to the through well 30, the pocket box 12 further has a holding frame 44 at the upper housing 40 and a respective holding wedge 46 at the lower housing 42. By engaging the holding frame 44 with the holding wedge 46, the upper housing 40 and the lower housing 42 is then made to form a close pocket box 12 (as shown in FIG. 4 and FIG. 5).

Figure 6:
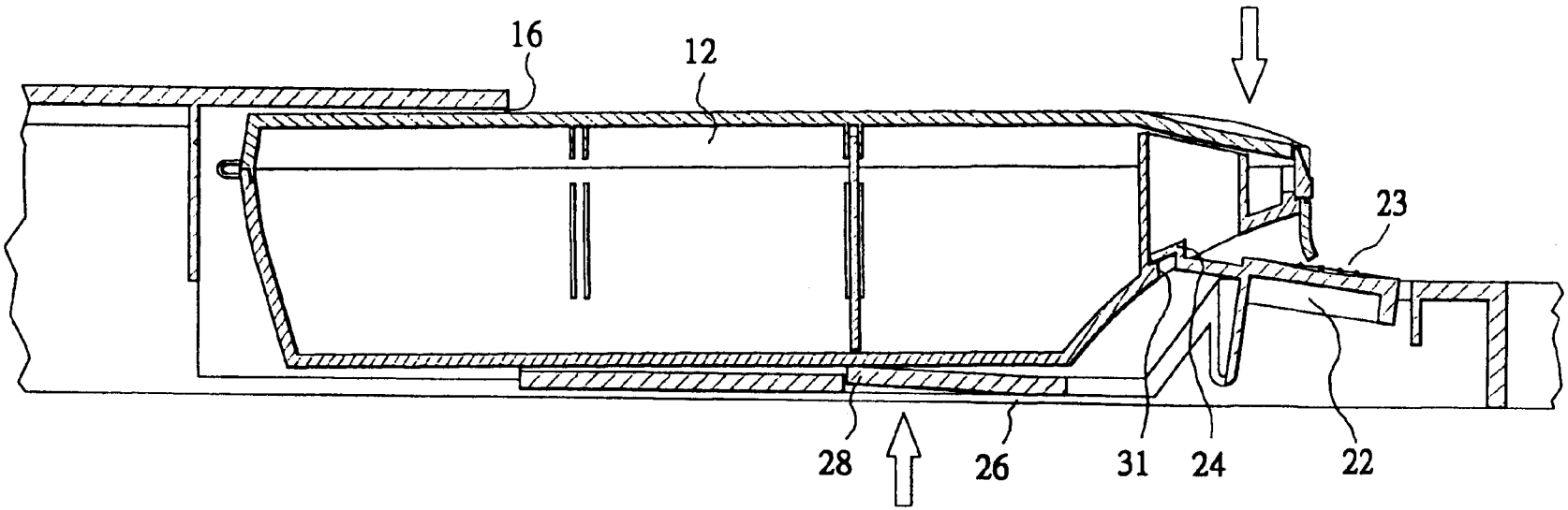
FIG. 6 is a cross-sectional view along line 6—6 of FIG. 2, showing only part of the preferred parts pack.
Figure 7:
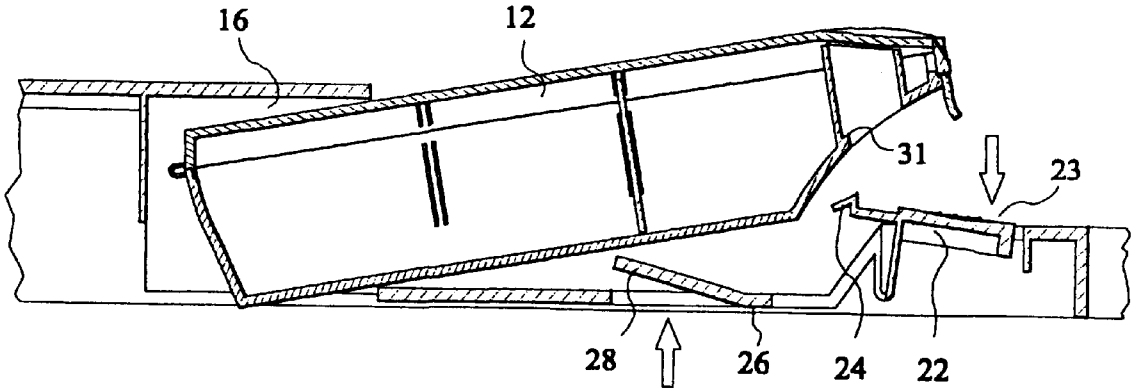
FIG. 7 and FIG. 8 show two consecutive states of removing the preferred pocket box from the preferred parts pack, based on the illustration in FIG. 6.
Figure 8:
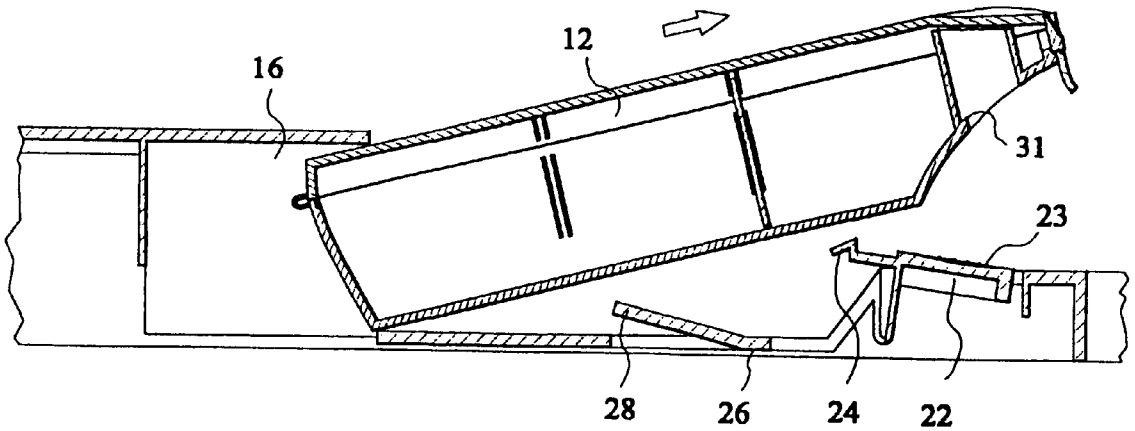

While the parts pack 10 at a close state, the holding hole 19 of the holding plate 18 can engage with the holding pin 20, and thus the parts pack 10 can be made portable by the handle 14 (as shown in FIG. 1) and standable on the ground by a plurality of the first stands 62 (not shown in figures). While the parts pack 10 at an open state, the parts pack 10 is made standable on the ground by a plurality of the second stands 64 (not shown in figures). Each of the pocket boxes 12 can be stored firmly in the respective first accommodation space 16, with the fastening flange 31 restricted by the hook portion 24 of the fastening hook 22 and having the pocket box 12 seated upon the tip 28 of the spring plate 26. While depressing the depression portion 23 of the fastening hook 22, the hook portion 24 moves upward to release the fastening flange 31 whereas the tip 28 of the spring plate 26 pushes the pocket box 12 upward, and thereby the pocket box 12 can be removed freely from the first accommodation space 16 (as shown in FIG. 6 to FIG. 8, wherein the arrow direction is the application direction). The removed pocket box 12 can be placed back into the first accommodation space 16 upon reversing the aforesaid procedures.

In addition, the casing 11 further includes a receiving platform 50 located inside the hinged end thereof for forming at least a second accommodation space 52 to receive hand tool such as the screwdriver 54, or various hand tool (as shown in FIG. 3).

The pocket box 12 can include therein at least a removable division plate 34. The removable division plate 34 is installed by two opposing pairs of first guiding rails 32 located at inner walls of the lower housing 42 of the pocket box 12. The removable division plate 34 is made to be restricted therebetween by a pair of second guiding rails 33 located inside the upper housing 40 of the pocket box 12 (as shown in FIG. 4). Thereby, the inside space of the pocket box 12 can be divided into two or more subspace.

The parts pack 10 in accordance with the present invention is substantially composed of two identical casing 11, so that the manufacturing is simplified. The pocket box 12 can be labeled to indicate the type of hardware sorted inside. The pocket box 12 and the casing 11 can apply different materials and colors, so that a specific vision effect can be achieved. Moreover, the number of first accommodation spaces 16 or pocket boxes 12 can also be adjusted to an appropriate number.

The pocket box 12 as shown in FIG. 4 is made in one piece by providing the connecting web 48 as a hinging structure, and comprises the holding frame 44 and the holding wedge 46 as a fastening structure. However, various combinations of previous structures can also be expected. For example, the combination of a flange located at the upper edge of the lower housing 42 and a respective dent located at the lower edge of the upper housing 40 can also be used to control the opening or closing of the pocket box 12 (not shown in figures).

While the present invention has been particularly shown and described with reference to preferred embodiments, it will be understood by those skilled in the art that various changes in form and detail may be without departing from the spirit and scope of the present invention.

What is claimed is:

1. A parts pack, formed as a box by hinging two identical one-piece casings, for accommodating a plurality of one-piece pocket boxes, wherein:

the casing, having one end thereof formed as a handle, having thereof another end forming a plurality of hinges located along an outer side thereof, and having a plurality of first stands located therealong close to the hinges at the outer side of the latter end;

the casing, having two lateral sides, with a holding plate at one lateral side and a holding pin at another lateral side, the holding plate further including a holding hole thereon, and according to an arrangement that the holding pin of one casing will engage fixedly with the respective holding hole of the holding plate of another casing while hinging the former casing and the latter casing to construct the parts pack at a close state;

the casing, including a plurality of first accommodation spaces at one surface thereof, and each the first accommodation space having a fastening hook and a spring plate thereof at one end;

the fastening hook, having a depression portion at one end thereof and a hook portion at another end thereof, a free end of the hook portion formed as a tip, and while depressing or releasing the depression portion, the hook portion reaching a protrusion state or a basic state, respectively;

the casing, having a plurality of second stands at another surface thereof;

each the pocket box, including thereof an upper housing and a respective lower housing, having a connecting web thereof at one end for bridging the upper housing and the lower housing such that thereby the upper and the lower housings form an openable box, having a division plate therein for forming a receiving space at another end thereof, further having a through well thereof adjacent to the division plate, the through well having a protruding fastening flange thereof at an lower portion, the pocket box further having a holding frame at the upper housing close to the through well and a respective holding wedge at the lower housing, and the upper housing and the lower housing made to form a close box by engaging the holding frame with the holding wedge; and while the parts pack at a close state, the holding hole of the holding plate engaging with the holding pin, thus the parts pack made portable by the handle and standable on the ground by a plurality of the first stands; while at an open state, the parts pack made standable on the ground by a plurality of the second stands; each of the pocket boxes stored firmly in the respective first accommodation space, with the fastening flange restricted by the hook portion of the fastening hook and the pocket box sitting upon the tip of the spring plate; while depressing the depression portion, the hook portion moving up to release the fastening flange whereas the tip of the spring plate pushing the pocket box upward, and thereby the pocket box made removable from the first accommodation space.

2. The parts pack of claim 1, wherein said casing further include a receiving platform located inside said hinged end thereof for forming at least a second accommodation space to receive hand tool.

3. The parts pack of claim 1, wherein said pocket box includes therein at least a removable division plate, the removable division plate installed by two opposing pairs of first guiding rails located at inner walls of the lower housing of the pocket box, and the removable division plate made to be restricted therebetween by a pair of second guiding rails located inside the upper housing of the pocket box.

* * * * *